United States Patent [19]

Waldrum

[11] Patent Number: 4,953,790

[45] Date of Patent: Sep. 4, 1990

[54] LOW COST APPLICATOR AND METHOD OF USE

[76] Inventor: John E. Waldrum, 349 Fairview Ave., Ambler, Pa. 19002

[21] Appl. No.: 252,784

[22] Filed: Oct. 3, 1988

[51] Int. Cl.[5] ..... B05B 9/08

[52] U.S. Cl. ..... 239/154; 239/195; 137/38; 416/70 R

[58] Field of Search ..... 416/69, 70 R; 415/88; 222/175; 239/152-154, 195-198, 745, 229, 723; 137/38

[56] References Cited

U.S. PATENT DOCUMENTS

| | | | |
|---|---|---|---|
| 1,323,793 | 12/1919 | Shevchenko | 415/88 |
| 1,769,342 | 7/1930 | Hall | 239/195 X |
| 2,162,057 | 6/1939 | Brandt et al. | 239/154 |
| 2,723,781 | 11/1955 | Funke | 222/175 |
| 3,095,123 | 6/1963 | Smith | 222/175 |
| 3,181,796 | 5/1965 | Keller | 415/88 X |
| 3,445,066 | 5/1969 | Mohar | 239/197 X |
| 3,472,456 | 10/1969 | Strong | 239/198 X |
| 3,690,560 | 9/1972 | Boyd | 239/195 |

OTHER PUBLICATIONS

"New Hudson Ultima Bak-Pak Sprayer", MCMLXXXIII, HDH Mfg Co. (81372).

*Primary Examiner*—Andres Kashnikow
*Assistant Examiner*—Kevin P. Weldon
*Attorney, Agent, or Firm*—Steele, Gould & Fried

[57] ABSTRACT

A low cost sprayer and method of using the sprayer is disclosed. The sprayer is formed with a length of flexible tubing having an inlet end and a tubing outlet end. A nozzle is secured to the outlet end of the hose in a manner to provide a predetermined flow pattern upon rotation of the tubing and nozzle. In use, the inlet end of the tubing is placed within an agricultural chemical containing tank and a predetermined length of the remainder of the tubing is rotated by a worker as he walks through the area to be sprayed. By varying the radius of the rotating portion of the tubing and by varying the type of spray nozzle employed, the swath width and the droplet size of liquid chemical application can be closely controlled. Granular agricultural chemicals can be applied by rotating a granular material nozzle about its axis while rotating the tubing in a vertical plane.

6 Claims, 3 Drawing Sheets

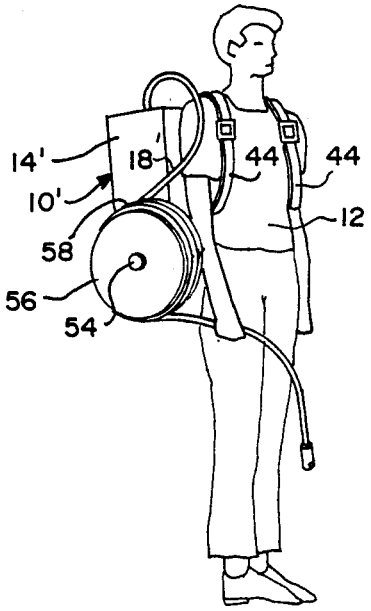
FIG. 4
FIG. 3
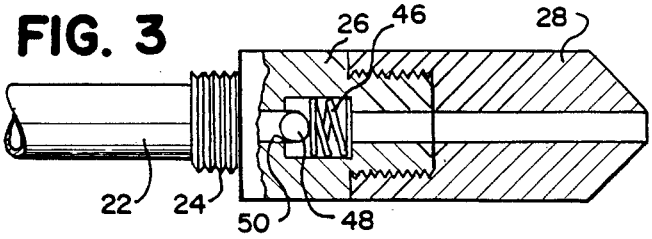
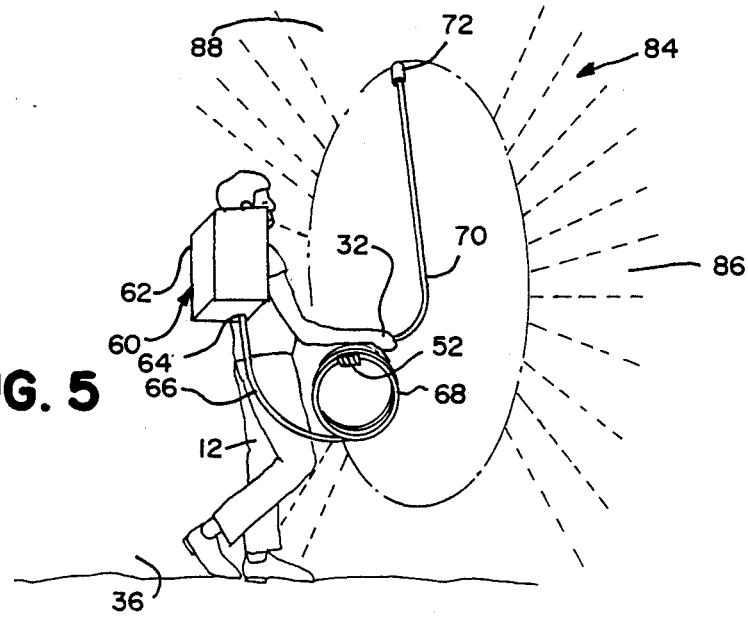
FIG. 5

FIG. 9
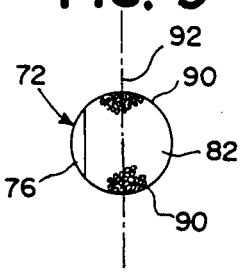
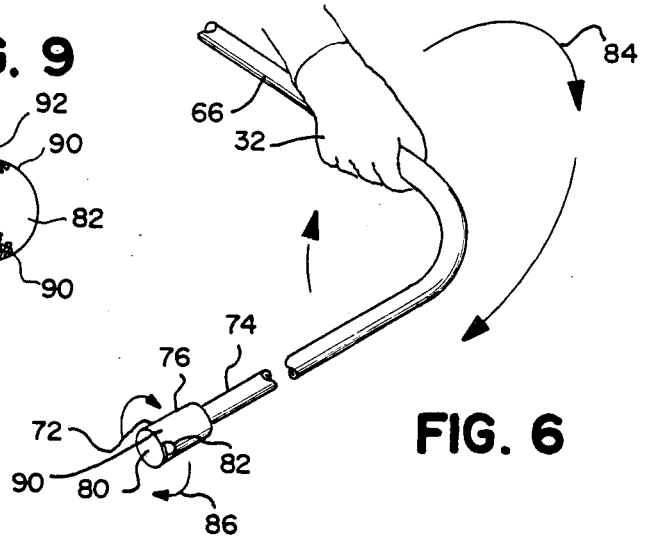
FIG. 6
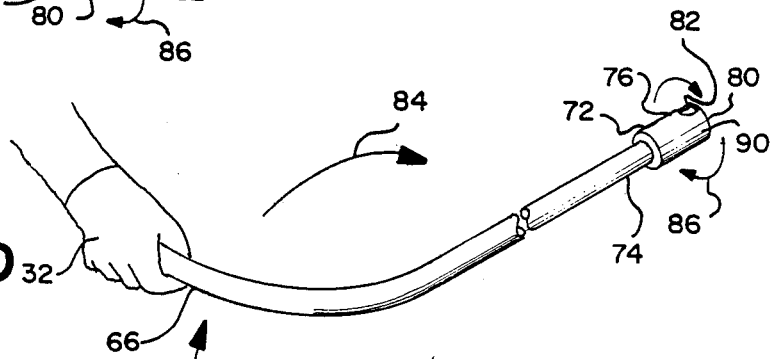
FIG. 7
FIG. 10
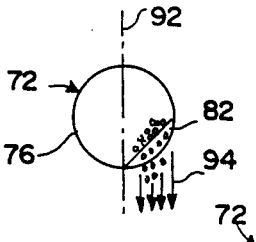
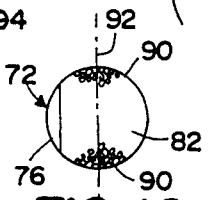
FIG. 12
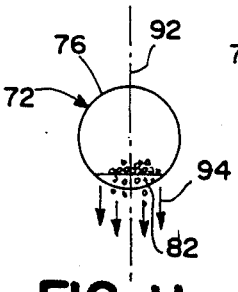
FIG. 11
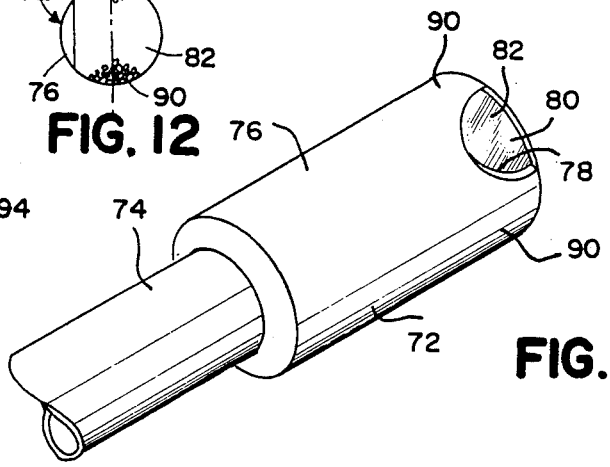
FIG. 8

LOW COST APPLICATOR AND METHOD OF USE

BACKGROUND OF THE INVENTION

1. Field of the Invention

This invention relates generally to devices for applying liquid and granular materials such as insecticides, fungicides, herbicides and fertilizers to ground surfaces, and more particularly, the invention relates to an extremely low cost apparatus suitable for manual use without vehicles and which employs rudamentary and unsophisticated structural components.

2. Discussion of the Prior Art

There are numerous known applicator devices which are available for ground application of liquid and granular materials such as herbicides, insecticides, fungicides, plant growth regulators, fertilizers and other agricultural chemicals. Most often, in developed countries, the applicator devices have been designed to obtain maximum coverage with minimum manual effort involved. The prior art spraying equipment has been utilized with both land vehicles and with aircraft. It is well known to employ tank type vehicles to store and transport the liquid materials to be applied in combination with a suitable boom device which carries a spray head having a plurality of nozzles mounted therein. The height of the boom above the ground can be readily varied as the vehicle is moved and the nozzles and spray head have been designed to carefully monitor the spray pattern and swath without causing excessive drift of the applied materials. One such spray applicator has been described and illustrated in my co-pending U.S. Pat. application, Ser. No. 885,773, filed July 15, 1986, entitled "GROUND SPRAY APPLICATOR", now U.S. Pat. No. 4,760,963.

The presently available ground spray applicator devices are relatively complicated in construction and expensive in manufacture. The existing equipment is intended to be adjustable to provide the desired type of spray application in a minimum amount of time with a minimum amount of manual involvement. While such equipment is efficient, cost effective and suitable for use in developed countries, the currently available spray applicators are usually too expensive for use in developing countries wherein there is usually an oversupply of manual labor and an undersupply of available monetary means to purchase the currently available sophisticated equipment. Accordingly, even though the need for efficient liquid and granular material applicators remains equally the same in both third world countries and in developed countries in order to approach maximum crop production, the third world countries have suffered dramatically from the lack of availability of suitable applicator equipment due to the very cost of such equipment. Under the circumstances, a pressing need remains to provide simple and cost effective liquid and granular material applicator systems which can be readily employed in all countries, especially those countries that are relatively poor and agriculturally deprived.

SUMMARY OF THE INVENTION

The present invention relates generally to applicators for applying liquid and granular agricultural chemicals, and more particularly, is directed to an extremely low cost, simply constructed and easily used applicator system suitable to deliver a liquid or granular agricultural chemical over a large ground area with easily adjusted flow rates and swath width.

The low cost applicators of the present invention are particularly designed for manual use by an individual without the need for associated machinery or vehicles. The applicators comprise essentially a thin, flexible, plastic or other suitable material tube or hose of sufficient diameter for the application of a desired quantity of agricultural liquid or granular chemicals. For example, plastic tubing of between $\frac{3}{8}$ inches to $\frac{3}{4}$ inches has proved satisfactory for the purpose. To the distal end of the hose or tube is affixed a fitting of conventional design to threadedly engage thereon a suitable interchangeable nozzle. In the case of handling liquid chemicals, any preselected droplet size and volume of application can be easily achieved by changing from one known type of nozzle design to another, depending upon the desired conditions of application. In the case of granular material application, specially designed nozzles will be employed.

It is contemplated that the low cost applicators of the present invention will be utilized in conjunction with an agricultural chemical containing reservoir, such as a non-pressured metallic or plastic tank. The reservoir or tank is intended be carried upon the back of a worker in any known, comfortable manner, such as by employing left and right shoulder straps of suitable length. In order to feed liquid from the tank to the nozzle, the end of the plastic tube or hose opposite the nozzle end is first inserted downwardly into the tank below the liquid level and the remainder of the entire hose or tube is allowed to fall below the liquid level in the container. This maneuver will cause liquid from the container to fill the hose to thereby prime the hose for subsequent liquid application upon the ground. When the nozzle is lifted above the liquid level in the container with the hose in its filled condition, and the low cost sprayer is then ready for use. Nothing will run or dribble out inasmuch as the liquid is not under pressure. Preferably, a free end hose length of between five feet and twenty feet will be employed by the worker for revolution about his head. The remainder of the liquid filled and primed hose can be coiled and held by hand for easy transportation as the free hose end is revolved.

The worker can select a desired swath width simply by playing out the free end or nozzle end of the hose from the hose coil to achieve substantially any swath width. For example, if it is desired to form a swath width of ten feet, the worker will play out a hose length of five feet. Upon revolving the free end of the hose in a circle, the ten foot swath will be achieved. If a twenty foot swath is desired, then a ten foot length of hose free end should be employed. With the swath width thus easily preselected and the required length of hose free end played out, the worker can then rotate the uncoiled end of the hose about his head in a horizontal plane to thereby swing the nozzle in a complete three hundred and sixty degree peripheral path.

The manual rotation of the nozzle about the head of the worker will create centrifical forces at the nozzle which results in the development of a vacuum within the hose sufficient to pull the liquid material from the liquid container for application at the nozzle. The centrifugal forces generated by rotation of the nozzle will create sufficient pressures at the nozzle for all usual spraying applications, for example, pressures in the range of approximately thirty-five or forty pounds per square inch. The nozzle pressure thus achieved will cause the liquid materials to be discharged at the nozzle at the desired rate and droplet size, depending upon the nozzle design employed.

The rate of application of the agricultural liquids to the ground can simply and inexpensively be manually controlled by coordinating the number of revolutions of the hose and nozzle with the distance travelled by the worker. For example, in one easily learned application procedure, a worker could be trained to take one forward step with each complete revolution of the nozzle. In this manner, uniform product application density can easily be achieved for any selected swath width.

Where greater application densities might be required, for example, the worker could be instructed to twirl the nozzle in two complete revolutions for each single step, thereby doubling the quantity of application. Thus it is seen that a uniform application of the agricultural chemicals can be made with extremely simple equipment in an expeditious and cost effective manner. The rate of application can be relatively precisely controlled depending upon the number of revolutions of the nozzle to each step taken by the worker. Faster or slower speeds of coverage can be effected simply by the worker walking faster or slower, but the rate of application will remain constant. Accordingly, a more vigorous worker can apply the agricultural chemicals over a greater ground surface than an older or weaker worker, but the rate of application per square foot will remain the same so long as the ratio between steps and revolutions remains the same.

It will be appreciated that as workers become more familiar with the equipment they can develop individual application techniques at greatly increased proficiencies. For example, in one application embodiment, it is contemplated that the liquid spray device could be manipulated in a whip-like manner by controlling the movements of the worker's wrist. By whipping the nozzle to the left and then to the right, increased nozzle speeds can be achieved at preselected points about the peripheral application pattern, thereby increasing liquid pressure at those arcuate locations in the nozzle circular revolutions path.

Accordingly, a worker could whip or crack the nozzle to the left and then to the right during each revolution in a manner to thus increase nozzle speed and consquently nozzle pressures at the whip locations. Conceivably, a conventional spring-loaded shuttle valve could be employed in series with the nozzle whereby the shuttle valve could be controlled to open only upon increased pressures, for example pressures in the range of fifty psi to sixty psi. In this manner, there would be no liquid flow at all through the nozzle until such time as the nozzle was whipped or cracked to thus increase nozzle speed and accordingly, the pressure buildup at the nozzle. With pressure buildup sufficient to overcome the resistance of the shuttle valve spring generated at only preselected arc patterns about the nozzle arcular path, it is conceivable that liquid flow could be thereby controlled to permit flow through a preselected arc of nozzle rotation and to prevent flow through the remaining arc of rotation.

In the case of granular chemical application, a unique dry product nozzle will be engaged at the free end of the tube or hose. The inlet end of the tube can be connected at the bottom of a portable, granular material, tank or container of size and design suitable to be easily carried by a single worker. Preferably, the container will be equipped with the shoulder straps or the like to facilitate transport on the back of the worker as the worker walks through the area to be treated. The dry material nozzle itself is unique in that it contains only a cylindrical or other shaped hollow body having an arcuate delivery opening formed in the outer periphery of the distal end of the nozzle. Perferably, the delivery opening will extend through an arc of approximately ninety degrees to facilitate control of the granular material application pattern.

It has been discovered that the delivery opening in the distal end of the granular material nozzle can be caused to naturally continuously rotate through three hundred and sixty degrees upon rotation of the hose free end. This phenomenon can be caused by bending the hose or tube through ninety degrees and then rotating the free end of the hose or tube through three hundred and sixty degrees about the axis of the unbent hose portion. It will be appreciated that the axis of rotation of the granular material nozzle will be angularly offset from the axis of rotation of the distal end of the hose through an angle of ninety degrees. Keeping in mind the rotating delivery opening of the nozzle, by controlling the nozzle rotative path, the delivery pattern of the material can be controlled.

It is therefore an object of the present invention to provide extremely simple and low cost sprayers of the type set forth and the methods of using the same.

It is another object of the present invention to provide a novel low cost sprayer comprising a flexible hose and interchangeable nozzles, the sprayer having no relatively moving parts.

It is another object of the present invention to provide a novel low cost sprayer and method of use wherein the manual rotation of the sprayer nozzle develops sufficient pressure at the nozzle for liquid chemical spray application.

It is another object of the present invention to provide a novel low cost sprayer and method of use comprising a length of small diameter flexible hose, a replaceable, interchangeable nozzle secured to the outlet end of the hose, the inlet end of the hose being placed within an agricultural liquid containing container and wherein liquid spraying pressures can be developed at the nozzle by manually continuously rotating the nozzle through an arc of three hundred and sixty degrees in a horizontal plane.

It is another object of the present invention to provide a novel, low cost granular material applicator and method of use comprising a length of flexible hose, a granular material nozzle affixed to the distal end of the hose, the end of the nozzle being provided with an arcuate, peripherally positioned opening to facilitate delivery of granular agricultural chemicals at right angles to the axis of the nozzle.

It is another object of the present invention to provide low cost sprayers and methods of use that are extremely inexpensive in manufacture, easily used without employing mobile equipment and trouble-free when in use.

Other objects and a fuller understanding of the invention will be had by referring to the following description and claims of a preferred embodiment, taken in conjunction with the accompanying drawings, wherein like reference characters refer to similar parts throughout the several views and in which:

BRIEF DESCRIPTION OF THE DRAWINGS

FIG. 3 is an enlarged, detailed view, partly in section, showing a shuttle valve in series connection with a liquid spray nozzle.

FIG. 4 is a perspective view showing a modified embodiment of a low cost sprayer.

FIG. 5 is a perspective view showing a modified, low cost spray apparatus suitable for granular material application purposes by employing interrupted, diametrically opposed spray patterns in a vertical plane.

FIG. 6 is a perspective view of a portion of the granular material applicator of FIG. 5 showing the nozzle opening facing in a first direction.

FIG. 7 is a perspective view of the portion of the granular material applicator of FIG. 5 wherein the nozzle opening has rotated to face a different direction.

FIG. 8 is an enlarged, perspective view of the granular material applicator nozzle.

FIGS. 9–12 are diagrammatic views showing various positions of the nozzle of FIG. 8 relative to the plane of rotation.

DESCRIPTION OF THE PREFERRED EMBODIMENTS OF THE INVENTION

Figure 1:
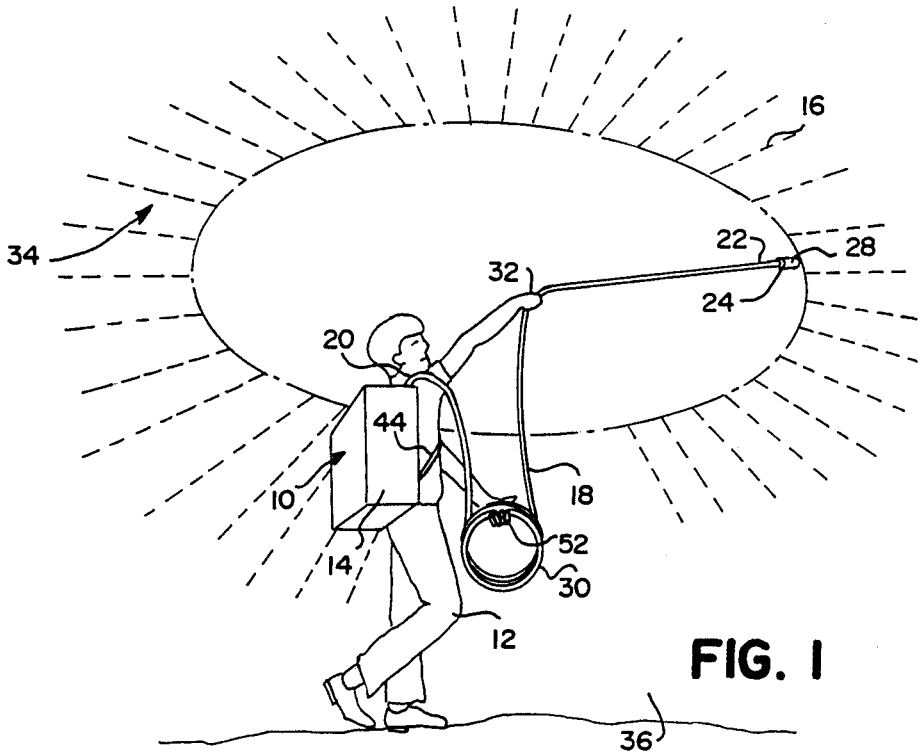
FIG. 1 is a perspective view showing a low cost liquid sprayer of the present invention in use by employing a complete three hundred and sixty degree spray pattern in a horizontal plane.

Although specific terms are used in the following description for the sake of clarity, these terms are intended to refer only to the particular structure of the invention selected for illustration in the drawings, and are not intended to define or limit the scope of the invention.

Figure 2:
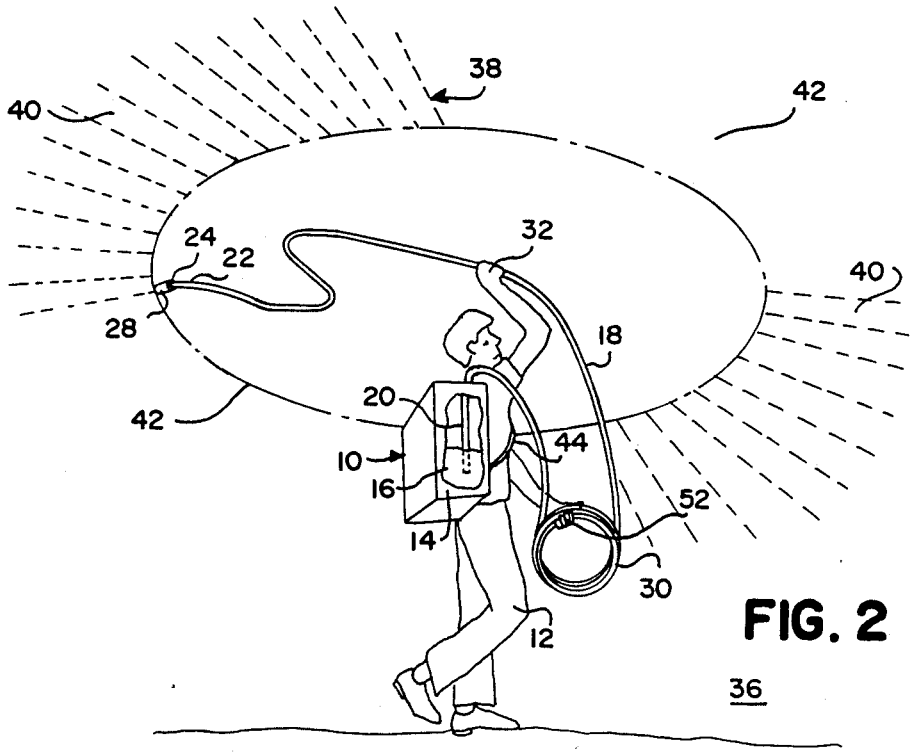
FIG. 2 is a perspective view showing the low cost sprayer of FIG. 1 exmployed as a whip sprayer to develop interrupted, diametrically opposed spray patterns.

Referring now to the drawings, there is shown in FIGS. 1 and 2 a low cost sprayer 10 constructed in accordance with the teachings of the present invention. The low cost sprayer 10 is designed to be manually carried by a man or worker 12 for direct application of liquid agricultural chemicals 16 upon a ground surface such as a field 36 to be sprayed.

The low cost sprayer 10 comprises generally a length of relatively small diameter hose or plastic tubing 18 which may be in the range of approximately ⅜ inches to ¾ inches in diameter for most uses. However, it will be appreciated that smaller diameter and larger diameter lengths of tubing may be employed in similar manner should greater or smaller volumes of agricultural chemical liquid application be desired.

As shown, the intake end 20 of the hose or tube 18 is applied interiorly of a conventional liquid chemical tank or container 14 below the level of the liquid chemical 16 stored therein. Preferably, a worker 12 can wear or support the container 14 upon his back by employing conventional shoulder straps 44 so as to permit the sprayer system 10 to have a wide range of mobility and application. The outlet or nozzle end 22 of the hose or tube 18 can be equipped with a conventional threaded fitting 24 in a manner to selectively receive any one of a number of known, conventional, spray nozzles 28. A suitable nozzle 28 can be adopted from the multitude of existing prior art nozzles having a design suitable for the application of a desired volume of liquid chemical 16 with a desired liquid particle or droplet size. Larger or smaller droplet sizes can be achieved by selecting an existing nozzle design of type well known to those skilled in the art of suitable design for the intended purposes.

If desired, a shuttle valve 26 of known design (see FIG. 3) may be interposed between the nozzle end 22 of the flexible hose 18 and the nozzle 28 to require that a sufficient amount of pressure be built up within the hose prior to the release of any liquid through the nozzle 28. Shuttle valves 26 of known design can be selected to require operation at any desired pressure, for example, 20 psi nozzle pressure to 50 psi nozzle pressure. However, it will be appreciated that the use of such a shuttle valve is optional and that the sprayer system 10 of the present invention could be utilized without such additional apparatus whenever desired.

Referring still to FIGS. 1 and 2 in order to use the low cost liquid sprayer 10 of the present invention, the hose intake end 20 should first be placed within the container 14 below the level of the liquid chemical material 16. The remainder of the hose 20 and the nozzle 28 should then be initially depressed below the liquid level. In this condition, the entire interior volume of the hose or tube 18 will be filled with the liquid chemical 16, but none will normally leak out through the nozzle 28 in view of the relative lack of nozzle pressure. After the hose 18 is filled, the nozzle 28 can then be lifted above the liquid level wherein the liquid will remain within the tubing and will not have a tendency to run out. With the equipment thus primed, the worker 12 can then begin the spraying operation by walking across the field 36 in a deliberate path or pattern. Simultaneously with the walking movement of the worker 12, a desired length of hose should be played out a distance to equal one half of the desired swath width. One hand 32 of the worker 12 then can grip the hose 18 intermediate its ends to define the desired free length. The worker then rotates the free hose end or nozzle end 22 about his head through an arc of three hundred and sixty degrees in a horizontal plane as he walks through the field to be treated.

This rotation of the nozzle 28 will generate centrifical forces, which forces may be increased or decreased by rotating the nozzle more or less rapidly about the head of the worker. When sufficient nozzle pressures are generated by the centrifical forces caused by the nozzle rotation, for example, pressures in the range of 20 psi to 40 psi, then liquid flow through the nozzle will be achieved. The flow of liquid through the nozzle will cause suction or vacuum forces to occur within the interior of the hose or tube 18. The vacuum thus created will cause liquid chemical 16 from the container 14 to flow into the hose intake end 20 to continuously and automatically replenish the liquid material dispersed at the nozzle 28.

Accordingly, by continuously rotating the nozzle 28 in a horizontal plane about the head of the worker 12 while the worker walks along a predetermined path, a uniform swath of agricultural liquid chemical can be applied to the field 36. While the worker 12 has been described as walking while applying the liquid chemical, it is also possible that the worker could ride while rotating the end of the hose 18 and the nozzle 28, for example, by riding upon an open truck, a tractor, or perhaps a burrow or donkey.

As illustrated in FIGS. 1, 2 and 3, it is anticipated that in most applications, a complete three hundred and sixty degree peripheral flow pattern 34 will be generated and will be utilized for uniform application. However, as above set forth, is conceivably possible to provide an interrupted flow pattern. Such an interrupted flow pattern could be achieved by employing a shuttle valve 26 in series with a nozzle 28 in a manner to require at least a preslected minimum liquid pressure at the nozzle 28 prior to any liquid flow. Then by whipping the nozzle at predetermined points about the three hundred and sixty degree arc of rotation, for example, to the immediate left and to the immediate right of the worker 12, the worker could, by causing a whipping action of his wrist, create increased velocities and elevated nozzle pressures. The pressure generated by "cracking the whip" would be sufficient to overcome the bias of the shuttle valve spring 46 to thus allow the ball 48 to leave its seat 50. When the valve was thus opened at predetermined arcuate locations in the circular path, an interrupted flow pattern, such as the interrupted flow pattern 38 diagramatically illustrated in FIG. 2 can be developed. As illustrated, the interrupted flow pattern 38 could comprise one or more liquid chemical, arcuate dispersal zones 40 and one or more arcuate non-dispersal zones 42.

As best seen in FIGS. 1 and 2, it is contemplated that the hose or tube 18 will be formed in a coil 30 suitable to be held in the other hand 52 of the worker 12. Accordingly, it is an extremely simple manner to vary the width of swath by simply uncoiling or recoiling portions of the hose or tube 18 from the coil 30 as necessary to achieve the desired radius of rotation. In the event that a free length of tube of approximately twenty feet was employed, then the maximum swath width would be approximately forty feet inasmuch as substantially the entire twenty foot length could be played out and rotated, thereby creating a forty foot circle of application.

A modified embodiment 10' of the low cost liquid sprayer is shown in FIG. 4 wherein a modified agricultural liquid container 14' is illustrated. The modified low cost sprayer 10' is intended to similarly be carried by a workman 12 in any convenient arrangement, for example, by employing shoulder straps 44 in well known manner. A reel 56 of conventional design is affixed to the tank or container 14' and is designed for rotation about the container affixed pin or shaft 54. The spraying hose or tube 18' encircles the reel 56 in a coil 58 and is designed to be readily played out or reeled into the coil 58 as necessary in order to achieve the desired width of swath of the liquid application pattern. If desired, the reel 56 may be spring loaded (not shown) in well-known manner to enhance the utility of the reel. In this embodiment, there would be no need for the worker 12 to manually form a hose coil 30 as illustrated in FIGS. 1 and 2, inasmuch as the reel 56 would be employed to perform this function and to automatically maintain the hose in a coil 58 whenever the application swath was less than double the entire extended length of the hose.

Referring now to FIG. 5, a granular material dispensing apparatus 60 is illustrated in use by a single workman 12. The granular material sprayer embodiment 60 comprises a container or tank 62 containing dry agricultural chemicals (not shown) in granular configuration. The container 60 may be similar to the container 14 except that a bottom dispensing outlet 64 is employed. Shoulder straps similar to the shoulder straps 44 illustrated in FIG. 4 can be advantangeously employed to facilitate carrying the dry materials for subsequent application to the field 36 to be treated. A flexible hose or tube 66 of suitable interior diameter for the application has its inlet end connected at the container bottom outlet 64 to receive gravity flow of dry or granular materials from within the container 62. In the manner hereinbefore described in connection with the embodiment illustrated in FIGS. 1 and 2, the unextended portion of the hose 66 can be arranged in a coil 68 for grasping and carrying by one hand 52 of the worker 12. The free end 70 of the hose or tube 66 is held by the other hand 32 of the worker for rotation of the end affixed granular material nozzle 72 in a vertical plane as illustrated. Perferably, the vertical material application plane should be angularly offset from the vertical plane representing the direction of travel of the worker 12.

The granular material nozzle 72 affixes to the distal end 74 of the granular material hose or tube 66 and comprises generally an outer, continuous sidewall or body 76, which body defines a hollow interior 78. While a cylindrically shaped nozzle is illustrated and is presently considered to be the preferred embodiment, it will be appreciated that other shapes and configurations of nozzles could be employed and still fall within the meaning and scope of the invention. The nozzle 72 terminates endwardly in a closed bottom 80, which bottom is continuously connected to the end of the nozzle body 76 in a leak-proof junction. As best seen in FIG. 8, arcuate delivery opening or slot 82 is formed in the nozzle sidewall immediately adjacent to the nozzle bottom 80. The delivery opening 82 should be of suitable dimensions and configuration to optimumly dispense or spray agricultural granular materials from the container 62 as the free end 70 of the hose or tube 66 is rotated in a vertical plane by a worker 12, in the manner hereinafter more fully set forth.

Referring now to FIGS. 5, 6 and 7, it is a feature of use of this embodiment for the worker 12 to grasp the dry material hose or tube 66 intermediate its ends with one hand 32 and then to bend the hose through ninety degrees as shown. The worker tightly grasps the intermediate section of the hose and then rotates the free or distal end 74 with the attached nozzle 72 in a vertical plane through a continuous arc of three hundred and sixty degrees. (see FIG. 5). Surprisingly, the actions of grasping the intermediate portion of the hose, bending the free end 72 of the hose 66 through ninety degrees about the hand 32 of the worker and then rotating the free end of the hose in a vertical plane will cause continuous axial rotation of the dry material nozzle 72 at the end of the hose. In other words, when the distal end of the hose is rotated in a vertical plane as illustrated by the large circular arrows 84 in FIGS. 6 and 7, the nozzle 72 will be caused to rotate about the longitudical axis of the distal end 74 of the hose or tube 66 as illustrated by the small circular arrows 86.

It will be appreciated that the axial rotation of the nozzle 72 as the free end of the hose is vertically rotated will cause the nozzle delivery opening 82 to continuously rotate about the axis of the nozzle. It has been found that the nozzle opening will thereby function to automatically and naturally provide an interrupted flow pattern 84 comprising a pair of equal and opposite dispersal zones 86 and intermediate equal and opposite non-dispersal zones 88 as the free end 70 of the hose or tube 66 is vertically rotated. This interrupted flow pattern phenomenon, as best seen in FIG. 5, is a direct result of the varying angular relationship between the nozzle delivery opening 82 and the plane of rotation of the hose free end 70.

By way of further explanation, as previously set forth, the arc about the nozzle periphery encompassed by the delivery opening 82 is designed to be approximately ninety degrees. Accordingly, when the nozzle opening 82 is rotated to a position that is ninety degrees offset from the plane of rotation of the hose free end 70, then only closed portions 90 of the nozzle sidewall 76 will be positioned to face in the direction of the plane of rotation 92. See FIG. 9. In this nozzle position, no portion of the nozzle opening 82 will be facing in the direction of the plane of rotation and so no granular materials will flow. This position of the nozzle delivery opening 82 and a one hundred and eighty degree offset position will therefore cause the non-dispersal zones 88 of the interrupted flow pattern 84 (FIG. 5). After gaining familiarity with the equipment 60, a worker can so control the rotative position of the nozzle opening 82 relative to the vertical rotative pattern of the hose free end 70 so that the non-dispersal zones 88 will be positioned vertically as illustrated, and one hundred and eighty degrees apart. In this manner, the worker will not be troubled with a granular material flow pattern that will cause some of the spread material to fall directly upon the worker 12.

Referring now to FIGS. 10 and 11, other rotative positions of the nozzle 72 are illustrated wherein at least portions of the nozzle opening 82 have been rotated to a position wherein the opening at least partially faces the plane of rotation 92. It will be appreciated that centrifugal forces will be built up as the hose free end 70 rotates through the plane 92. These forces will all act peripherally through the rotative plane 92, thereby causing the granular materials to exit the nozzle 72 in the rotative plane as indicated by the flow arrows 94. This granular material flow will create the dispersal areas 86 of the interrupted flow pattern 84 as illustrated in FIG. 5. Thus it is seen that continual rotation of the hose free end 80 through the vertical plane 92 will cause continous axial rotation of the nozzle delivery opening and the interrupted flow pattern 84 comprising the alternating disperal areas 86 and non-dispersal areas 88.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. The method of using a low cost sprayer of the type comprising a length of flexible hose, the hose having an inlet and an outlet and a nozzle secured to the hose outlet comprising placing the hose inlet end into an agricultural chemical containing tank;

elevating a portion of the hose and the nozzle above the tank; and rotating the portion of the hose and the nozzle through an arc of three hundred and sixty degrees to cause agricultural chemical flow through the nozzle;

moving the tank while rotating the portion of the hose and the nozzle; and rotating the nozzle at non-uniform velocity through the arc of rotation.

2. The method of claim 1 wherein the rotating is in a horizontal plane.

3. The method of claim 1 wherein the chemical flow through the nozzle is interrupted.

4. The method of claim 1 wherein the rotating is in a vertical plane.

5. The method of using a low cost sprayer of the type comprising a length of flexible hose, the hose having an inlet and an outlet and a nozzle having a longitudinal axis secured to the hose outlet comprising:

placing the hose inlet end into a agricultural chemical contain tank;

elevating a portion of the hose and the nozzle above the tank;

rotating the portion of the hose and the nozzle through an arc of three hundred and sixty degrees to cause agricultural chemical flow through the nozzle;

moving the tank while rotating the portion of the hose and the nozzle;

rotating the nozzle at uniform velocity throughout the arc of rotation, and rotating the nozzle about its longitudinal axis while the portion of the hose is rotated in a vertical plane.

6. The method of claim 5 wherein the rotating of the nozzle is in a vertical plane.

* * * * *